US005782271A

United States Patent [19]

Wahhoud et al.

[11] Patent Number: 5,782,271

[45] Date of Patent: Jul. 21, 1998

[54] MULTI-SECTION REED FOR AIR JET LOOM

[75] Inventors: Adnan Wahhoud, Lindau-Bodolz; Peter Czura, Wangen, both of Germany

[73] Assignee: Lindauer Dornier Gesellschaft mbH, Lindau, Germany

[21] Appl. No.: 761,947

[22] Filed: Dec. 9, 1996

[30] Foreign Application Priority Data

Dec. 8, 1995 [DE] Germany ..... 195 45 840.0

[51] Int. Cl.[6] ..... D03D 49/62

[52] U.S. Cl. ..... 139/192; 139/434; 139/435.6

[58] Field of Search ..... 139/435.6, 192, 139/302, 435.5

[56] References Cited

U.S. PATENT DOCUMENTS

| | | | |
|---|---|---|---|
| 4,125,133 | 11/1978 | Kobayashi et al. | 139/435.6 |
| 4,538,649 | 9/1985 | Kobayahi et al. | 139/435.5 |
| 4,905,741 | 3/1990 | Wahhoud et al. . | |
| 5,253,681 | 10/1993 | Cramer et al. . | |
| 5,570,726 | 11/1996 | Wahhoud et al. | 139/192 |

*Primary Examiner*—Andy Falik

*Attorney, Agent, or Firm*—W. G. Fasse; W. F. Fasse

[57] ABSTRACT

A multi-section reed for a pneumatic loom includes at least two partial reeds or reed sections that are arranged spaced apart from one another, and a respective reed filler member arranged in the gap between the two reed sections. A substantially continuous or through-going weft insertion air channel is formed by individual air channel sections that are respectively provided in the individual reed sections and reed filler member and that are substantially aligned with each other. In a transition region between a first air channel section and a second consecutive or following air channel section, an inlet end of the second air channel section is enlarged or widened in a funnel-shaped or tapering configuration relative to the cross-sectional dimension of the remainder of the weft insertion air channel, and particularly the outlet end of the first air channel section. The enlarged tapering inlet end of the air channel section provides a smooth transition allowing the inserted weft thread to travel without interference from one reed member to the next, even if the reed members are slightly out of alignment with each other.

18 Claims, 2 Drawing Sheets

MULTI-SECTION REED FOR AIR JET LOOM

FIELD OF THE INVENTION

The invention relates to a reed for an air jet loom. The reed is divided into a plurality of reed sections with reed filler members arranged therebetween. A weft thread air insertion channel extends along the entire reed, and is made up of air channel sections respectively provided in the individual reed sections and filler members in substantial alignment with one another.

BACKGROUND INFORMATION

A multi-section reed for an air jet loom of the above described general type is disclosed in German Patent Publication DE 4,131,167 A1 and corresponding U.S. Pat. No. 5,253,681 (Cramer et al.), issued Oct. 19, 1993. The present invention is an improvement over the known multi-section reed of U.S. Pat. No. 5,253,681 and German Patent Publication DE 4,131,167 A1, and the entire disclosure of these two documents is incorporated herein by reference.

The known multi-section reed is divided into a plurality of reed sections spaced apart from each other with gaps or breaches therebetween. A respective so-called reed filler member is arranged in the area of each reed breach between neighboring reed sections and is constructed substantially similarly to the reed sections. In other words, each reed section and each reed filler member is made up of a plurality of reed teeth that are profiled so as to form a weft thread air insertion channel running along the reed sections and the reed filler members.

Thus, the one or more reed filler members simulate the air-technical characteristics of the air insertion channel of the reed so as to bridge the gap or breach between adjacent reed sections, especially when the reed is in the open or pulled-back position. In other words, the air insertion channel is continued through the filler members.

The known multi-section reed according to U.S. Pat. No. 5,253,681 has been successfully and advantageously used in situations when a gap in the produced fabric is desired, namely when it is desired to produce two or more separate fabric widths simultaneously on the same loom. However, it has been recognized that improvements in the known construction of the multi-section reed are possible, as follows. In the known reed, respective spaces remain between the respective reed sections and reed filler members, because a sufficient clearance or free play spacing must be provided therebetween to allow for the movement of the reed. For this reason, the weft thread insertion air channel is interrupted by respective gaps between the respective adjacent reed sections and filler members.

If the reed sections and the reed filler members are not very precisely aligned with one another, then a protruding edge or step is formed in the air insertion channel in the respective transition area between two neighboring sections of the air insertion channel. Such slight misalignments of the several reed sections relative to each other can arise due to improper adjustment or due to normal wear and tear of the reed members after an extended operating period of the loom. The resulting protruding edges or steps at the transition regions of the air insertion channel can interfere with the insertion travel of the weft thread through the air jet channel, i.e. the weft thread can become caught on the protruding edges or steps.

It is also known in the art to provide a funnel-shaped weft thread insertion guidance and alignment device at the inlet end of the air channel of the reed in a pneumatic loom. For example, U.S. Pat. No. 4,905,741 (Wahhoud et al.), issued Mar. 6, 1990, discloses such a weft thread insertion alignment device, which is stationarily arranged between a group of plural main insertion no nozzles and the inlet end of the air channel in the reed. The alignment device has an alignment slot that has a wider or larger inlet side and a narrower outlet side, having a height dimension substantially matching the height dimension of the air channel in the reed. The arrangement may also include an auxiliary reed positioned between the weft thread alignment device and the inlet end of the main reed, wherein the auxiliary portion of the air channel formed in the auxiliary reed is tapered or funnel-shaped to form a part of the tapered insertion alignment channel as a transition between the alignment device itself and the main air channel of the main reed.

This known arrangement of U.S. Pat. No. 4,905,741 relates to the guidance and alignment of a selected one of plural available weft threads at the inlet end of a main reed, i.e. between a bundle of plural main insertion nozzles and the inlet end of the main reed, and does not address the problem of misadjustments or misalignment of respective plural reed sections in a multi-section reed. For example, in the known arrangement using the auxiliary reed as described above, the inlet end of the air channel in the main reed substantially matches the dimensions of the outlet end of the tapered air channel in the auxiliary reed (see e.g. FIG. 5 of U.S. Pat. No. 4,905,741). In other words, the inlet end of the air channel in main reed does not have an enlarged inlet end, even though the transition region between the auxiliary reed and the main reed is precisely an area where fault-causing misalignments can occur. Any misalignment or misadjustment of the auxiliary reed relative to the main reed would lead to the formation of the above discussed protruding edge or step at the transition between the auxiliary reed and the main reed, which could cause the weft thread to be caught or otherwise impeded in its insert travel.

The present invention is further an improvement over the arrangement of U.S. Pat. No. 4,905,741, the entire disclosure of which is incorporated into the present application by reference.

OBJECTS OF THE INVENTION

In view of the above it is the aim of the invention to achieve the following objects singly or in combination:

to construct a multi-section reed for an air jet loom in such a manner so as to reduce or avoid negative influences on the air insertion travel of the weft thread in the transition areas between respective adjacent reed sections and filler members;

to reduce the need for extremely accurate alignment of the respective reed sections and filler members of a multi-section reed;

to avoid the formation of protruding edges or steps in the air jet channel at the transition areas between respective adjacent reed sections and filler members, even if the components become slightly misaligned due to operating wear; and to improve the overall effectiveness of air jet weft insertion of a loom having a multi-section reed, so as to reduce the number of weft faults and resultant weaving stoppages.

SUMMARY OF THE INVENTION

The above objects have been achieved in a multi-section reed for a pneumatic loom according to the invention, wherein the inlet or upstream end of an air channel section in a second successive reed section or filler member is larger than the outlet or downstream end of an air channel section in a first reed section or filler member arranged weft-downstream of the first reed section or filler member. Namely, at least one cross-sectional dimension of the inlet end is larger than the corresponding cross-sectional dimension of the adjacent outlet end of the preceding air channel section. More specifically, at least an inlet end portion of the air channel section is enlarged or expanded in the upstream direction in comparison to the rest of the air channel, preferably with a tapering funnel-shape A major feature of the invention is that the individual sections of the weft insertion air channel provided in the respective reed sections and reed filler members are embodied or shaped in such a manner that a protruding edge or step facing against the weft insertion direction cannot be formed in the transition region between one reed section and the next following reed section or filler member. This is achieved since the upstream or inlet end of a next successive air channel section is widened or expanded in a direction opposite the insertion direction, over at least a partial funnel-shaped end portion.

By these measures, the invention avoids the formation of protruding edges or steps that would tend to catch the weft thread in the transition area between successive sections of the air channel. As discussed above, such edges or steps could arise previously in the known multi-section reed, since the individual reed sections could become misaligned with one another due to inexact adjustments or due to self-acting displacements of the components over the course of time during operation of the loom.

Furthermore, the funnel-shaped expansion or widening of the thread inlet portion of the respective reed sections according to the invention allows certain tolerances in the positional and alignment adjustment of the reed sections and the reed filler members, since an interfering step or protruding edge can no longer arise at the transition areas or gaps of the weft insertion air channel. This advantage is assured as long as the adjustment tolerance is smaller than the degree or size of the funnel-shaped expansion of the air channel inlet portions relative to the air channel outlet ends.

Normally, the weft insertion air channel is approximately U-shaped, i.e. having three channel walls provided in the profile of the individual reed teeth. It is provided by the invention, that all three channel walls may be widened or expanded in the above described funnel-shaped inlet portion of the air channel section. Alternatively, it is also possible to expand the inlet portion of the air channel section only in the vertical direction or only in the horizontal direction as required for any particular situation. Since the cross-sectional dimensions of the air channel are typically relatively small, the extent of the funnel-shaped expansion is also relatively small, for example, on the order of a few or several millimeters.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
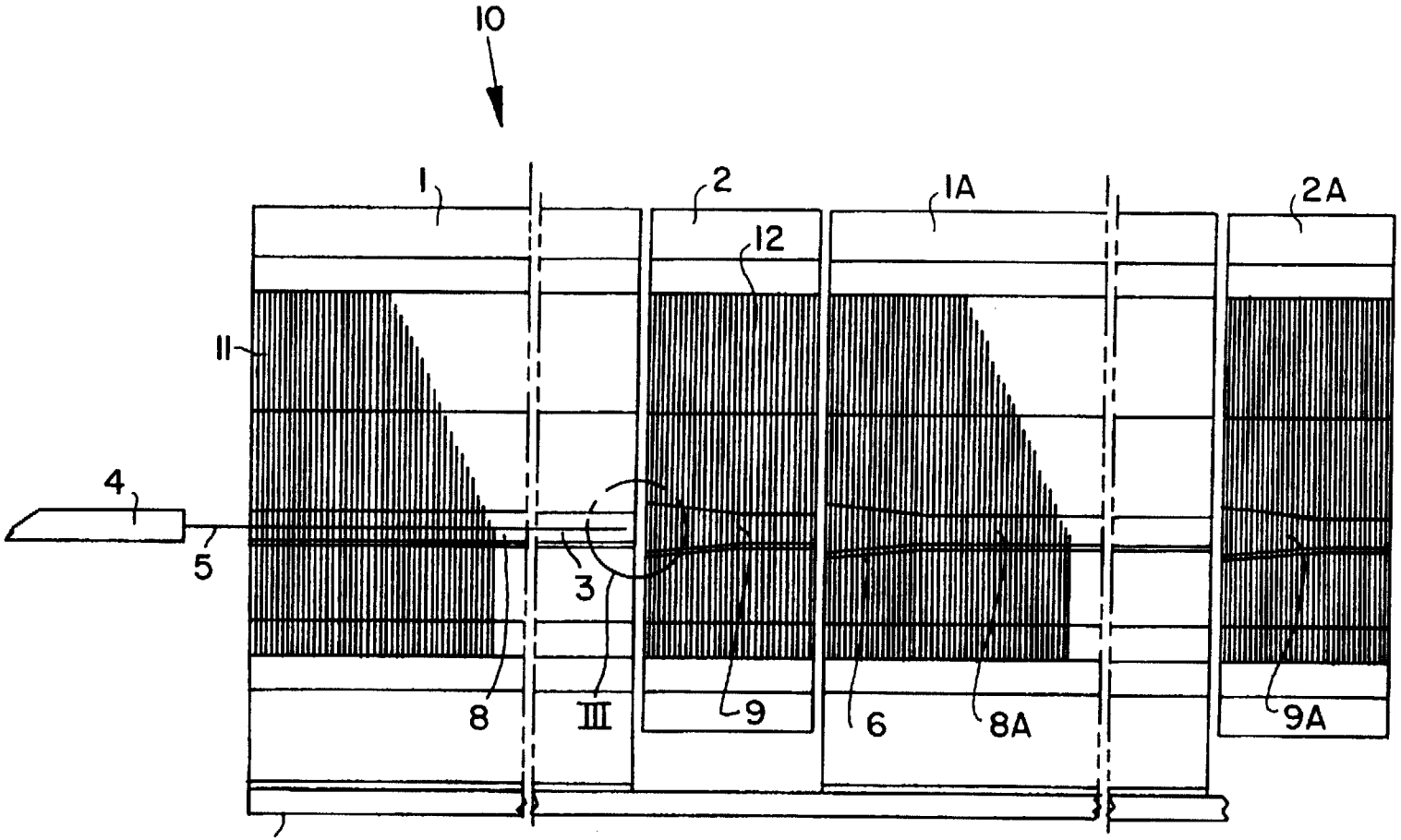
FIG. 1 is a schematic front view of a multi-section reed according to the invention.

FIG. 1 is a schematic front view of a multi-section reed 10 according to the invention. The multi-section reed 10 comprises a plurality of partial reed members, including partial reeds or reed sections 1 and 1A arranged spaced apart from one another with gaps or breaches therebetween and reed filler members 2 and 2A arranged respectively in the gaps between two adjacent consecutive reed sections. Thus, the multi-section reed 10 includes an alternating arrangement of reed sections 1, 1A, and filler members 2, 2A. Preferably, the reed sections 1 and 1A are mounted on a common reed beam 10A to carry out the beat-up motion in unison with one another, while the filler members 2 and 2A are mounted in a fixed or stationary manner and do not participate in the beat-up motion. The reed sections 1 and 1A and the filler members 2 and 2A come into alignment with one another as shown in FIG. 1 when the reed 10 is open or tilted back away from the beat-up. Alternatively, the filler members 2 and 2A may be arranged to move at least partially with the reed sections 1 and 1A.

Each reed section 1, 1A includes a plurality of reed teeth 11, and each filler member 2, 2A includes a plurality of reed teeth 12. The reed teeth 11 and 12 are profiled so as to form a weft thread insertion air channel 3 that extends across the entire width of the reed 10. The complete air channel 3 is made up of a plurality of air channel sections 8, 9, 8A and 9A respectively provided in the reed section 1, the filler member 2, the reed section 1A, and the filler member 2A. For economy of construction, most of the reed teeth 11 and 12 are all of the same type, i.e. have the same configuration and construction, while some of the reed teeth forming an inlet portion of each air channel section have specialized or different configurations to form the funnel-shaped expanded inlet portion according to the invention, as described below.

A main nozzle 4 arranged at the inlet or weft-upstream side of the reed 10 inserts or blows a weft thread 5 into the insertion channel 3, whereupon the weft thread 5 travels through the entire insertion channel 3 across the reed 10 to the other side, i.e. the outlet or weft-downstream side thereof. Auxiliary or relay nozzles may be arranged at spacings across the reed 10 as is generally known in the art.

The inventive arrangement primarily relates to an expanded or widened funnel-shaped inlet portion 6 provided at the inlet end of at least the air channel sections 9, 8A, and 9A of the filler member 2, the reed section 1A, and the filler member 2A respectively. The inlet end of the first reed section 1 may also have a widened funnel-shaped inlet portion if desired, but this is not necessary to achieve the objects of the invention relating to the avoidance of forming steps or protruding edges in the transition regions between reed sections and filler members where a weft thread may become caught. To better understand the arrangement according to the invention, the conventional multi-section reed arrangement will first be described with reference to FIG. 2.

Figure 2:
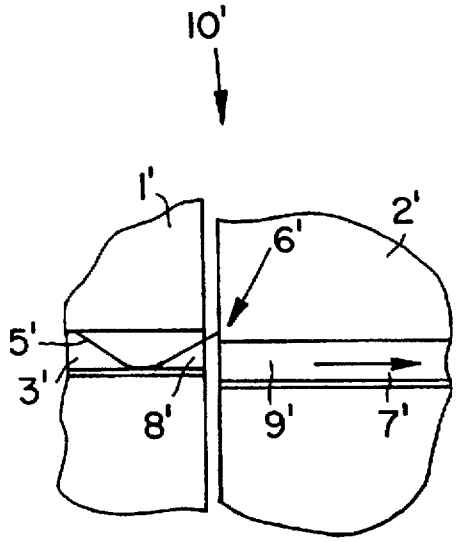
FIG.2 PRIOR ART
FIG. 2 is a detail view of the transition region between two adjacent successive reed sections in a conventional multi-section reed.

FIG. 2 is a detail view of the transition area between a first partial reed or reed section 1' and an adjacent successive filler member 2' of a multi-section reed 10' according to the prior art.

The prior art multi-section reed 10' has a through-going weft thread insertion air channel 3', including air channel sections 8' and 9' respectively provided in the reed section 1' and the filler member 2'. As can be seen in FIG. 2, the channel sections 8' and 9' of the air channel 3' are not exactly aligned with one another, but rather are slightly offset from one another as a result of inaccurate adjustment of the reed section 1' and/or the filler member 2' relative to each other, or due to ordinary wear of the components during operation of the loom. Due to the offset or misalignment of the air channel sections 8' and 9', a step or protruding edge 6' is formed at the inlet end of the air channel section 9'. As shown, the inserted weft thread 5' can become caught against the protruding edge 6' in the worst case, or at least is slowed down or otherwise impeded in its intended travel in the insertion direction 7'. Such catching of the weft thread 5' causes the weft thread monitor to signal a weft fault, whereupon the loom is stopped, in a manner that is conventionally known.

Figure 3:
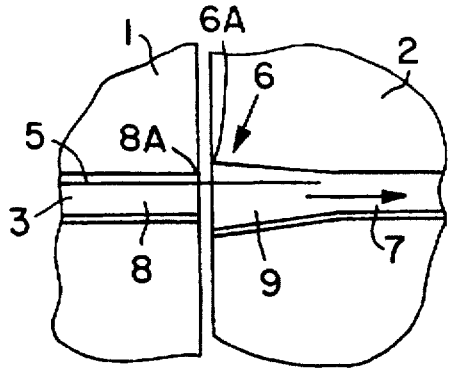
FIG. 3 is a schematic view of the detail area III in FIG. 1, namely of a transition region between two adjacent successive reed sections in the multi-section reed according to the invention.

In comparison to the prior art of FIG. 2, the detail view of FIG. 3 shows the inventive arrangement at the transition area between the first reed section 1 and the next adjacent reed filler member 2. The air channel section 9 in the reed filler member 2 has an inlet portion 6 that forms a transition portion. The inlet portion 6 of the air channel section 9 is widened or expanded with a funnel-shaped taper that becomes wider in a direction opposite the insertion direction 7. More specifically, the inlet end 6A of the inlet portion 6 has a cross-sectional dimension that is larger than the corresponding cross-sectional dimension of the outlet end 8A of the air channel section 8. The tapered configuration of the inlet portion 6 is formed by appropriately arranging specially configured reed teeth 12, for example having a correspondingly enlarged profile recess that forms the air channel.

Figure 4:
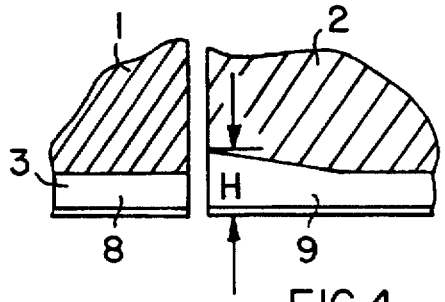
FIG. 4 is a schematic detail sectional view of a transition region between adjacent reed sections, seen in the vertical direction, for example from the top of FIG. 1 downward.

FIG. 3 shows that the inlet end 6A has an increased height or vertical dimension relative to the neighboring outlet end 8A, and it should be further understood that the width dimension or horizontal dimension H can be similarly widened as shown in the sectional top view of FIG. 4, which uses the same reference numbers for the same components discussed above. Individual reed teeth have been omitted from FIG. 4 for clarity. In any specific case, it may be desired to provide a widened dimension only in the horizontal direction or only in the vertical direction as a appropriate. Preferably, the enlarged cross-sectional dimension of the inlet end 6A is at least 1 mm larger than the corresponding dimension of the neighboring outlet end 8A.

The length of the tapering funnel-shaped inlet portion 6 in the weft insertion direction 7 is preferably in the range of at least 1 cm, while the remainder of the air channel section 9 has a continuous uniform cross-section defining the general cross-sectional configuration of the air channel 3. It is alternatively possible to extend the taper of the air channel section across the entire width in the weft insertion direction of the respective reed section or filler member. However, such a configuration is not preferred because it requires a greater number of specialized or non-standard reed teeth, and may result in less effective guidance and entrainment of the weft thread. The specific configuration of the taper may be substantially linear as shown in FIG. 3, or may be non-linear, for example, with a curve or parabolic vortex shape.

With the arrangement of the invention as shown in FIG. 2, the weft insertion air channel 3 will always provide an unobstructed insertion path for the weft thread 5, even if the reed sections 1 and 1A and the filler members 2 and 2A are slightly misaligned or offset from one another. Protruding edges or steps such as the protruding edge 6' shown in the prior art configuration of FIG. 2 cannot arise in the inventive arrangement of FIG. 3, as long as the magnitude of the flaring or widening of the inlet portion 6 of the air channel section 9 is greater than the degree of misalignment of the reed sections and/or filler members. Especially, no protruding edges or steps that face in a direction opposite the weft insertion direction 7 can be formed, while edges facing the downstream direction, such as the outlet end 8A of the air channel section 8, do not form an obstruction to the insertion travel of the weft thread 5.

The inventive configuration of the multi-section reed, or specifically the air channel, greatly reduces or avoids any obstruction or catching of the weft thread in the transition area between two successive adjacent sections of the reed, so that the occurrence of loom stoppages due to weft faults can be greatly reduced. The avoidance of protruding edges in the air channel also helps maintain the air jet within the channel with reduced dissipation. The flared inlet portion may even improve the air jet characteristics by a suction-effect drawing in ambient air.

Although the invention has been described with reference to specific example embodiments, it will be appreciated that it is intended to cover all modifications and equivalents within the scope of the appended claims.

What is claimed is:

1. A multi-section reed for a pneumatic loom comprising a plurality of partial reed members arranged successively adjacent one another with a respective space therebetween in a weft insertion direction of said loom, wherein said partial reed members respectively have weft insertion air channel sections extending therealong in at least substantial alignment with one another along said weft insertion direction to form a weft insertion air channel extending along said reed, wherein said plurality of partial reed members includes a first weft-upstream reed member and a second weft-downstream reed member arranged weft-downstream adjacent said first reed member, and wherein said air channel sections respectively have weft-upstream inlet ends and weft-downstream outlet ends, and said inlet end of said air channel section of said second reed member has an enlarged inlet cross-sectional dimension that is larger than a corresponding cross-sectional dimension of said outlet end of said air channel section of said first reed member.

2. The multi-section reed of claim 1, wherein said first weft-upstream reed member comprises a first weft-upstream reed section, said plurality of partial reed members further includes a second weft-downstream reed section arranged spaced apart from said first weft-upstream reed section with a gap therebetween in said weft insertion direction, and said second weft-downstream reed member comprises a reed filler member arranged in said gap between said first and second reed sections.

3. The multi-section reed of claim 2, further comprising a common reed beam adapted to be tiltably movable in said loom to carry out a beat-up motion between a weft insertion position and a beat-up position, wherein said reed sections are mounted on said common reed beam, and said reed filler member is arranged stationarily in said loom such that said reed filler member is between and substantially aligned with said reed sections when said reed beam is tilted back into said weft insertion position.

4. The multi-section reed of claim 1, wherein said air channel section of said second reed member comprises a tapering inlet portion commencing at said inlet end thereof and tapering downstream in said weft direction from said enlarged inlet cross-sectional dimension to said cross-sectional dimension of said outlet end.

5. The multi-section reed of claim 4, wherein said air channel section of said second reed member further comprises a major channel portion extending from said tapering inlet portion to said outlet end thereof, wherein said major channel portion has a uniform cross-sectional dimension substantially equal to said cross-sectional dimension of said outlet end.

6. The multi-section reed of claim 5, wherein said tapering inlet portion has a length in said weft insertion direction in the range of at least 1 cm.

7. The multi-section reed of claim 4, wherein said tapering inlet portion is substantially funnel-shaped.

8. The multi-section reed of claim 4, wherein said tapering inlet portion has a substantially linear taper.

9. The multi-section reed of claim 4, wherein said tapering inlet portion has a curved taper.

10. The multi-section reed of claim 1, wherein said enlarged inlet cross-sectional dimension comprises a first vertical dimension and said corresponding cross-sectional dimension of said outlet end comprises a second vertical dimension.

11. The multi-section reed of claim 10, wherein only said first vertical dimension is enlarged relative to said second vertical dimension, and a horizontal cross-sectional dimension of said inlet end is equal to a horizontal cross-sectional dimension of said outlet end.

12. The multi-section reed of claim 1, wherein said enlarged inlet cross-sectional dimension comprises a first horizontal dimension and said corresponding cross-sectional dimension of said outlet end comprises a second horizontal dimension.

13. The multi-section reed of claim 12, wherein only said first horizontal dimension is enlarged relative to said second horizontal dimension, and a vertical cross-sectional dimension of said inlet end is equal to a vertical cross-sectional dimension of said outlet end.

14. The multi-section reed of claim 1, wherein said enlarged inlet cross-sectional dimension includes an enlarged dimension and an enlarged horizontal dimension.

15. The multi-section reed of claim 1, wherein said enlarged inlet cross-sectional dimension is larger than said cross-sectional dimension of said outlet end by an amount in the range of a few millimeters.

16. The multi-section reed of claim 1, wherein said first reed member comprises a first reed section having a first one of said air channel sections extending therealong, said second reed member comprises a reed filler member having a second one of said air channel sections extending therealong, and said plurality of partial reed members further comprises a second reed section having a third one of said air channel sections extending therealong, with said first reed section, said reed filler member, and said second reed section arranged in successive adjacent order beginning from a weft insertion side of said reed, wherein said inlet end of said second air channel section of said reed filler member and said inlet end of said third air channel section of said second reed section both respectively have said enlarged inlet cross-sectional dimension, and said inlet end of said first air channel section of said first reed section has a non-enlarged inlet cross-section corresponding to an outlet cross-section of said outlet end of said first air channel section of said first reed section.

17. The multi-section reed of claim 1, wherein said inlet end of said air channel section of each one of said reed members except for a first one of said reed members at a weft insertion side of said reed has said enlarged inlet cross-sectional dimension.

18. A reed arrangement for a pneumatic loom, comprising a plurality of reed sections respectively arranged spaced apart from one another with a respective gap between successive ones of said reed sections, and a respective reed filler member arranged in each said gap between said successive reed sections, wherein said reed sections and said respective filler member each have a respective weft insertion air channel section extending therealong, with all of said air channel sections in substantial alignment to form a weft insertion air channel extending along said reed arrangement in a weft insertion direction, and wherein each one of said air channel sections that is weft-downstream adjacent a respective preceding one of said air channel sections has an inlet end with a larger cross-sectional dimension than a corresponding cross-sectional dimension of an outlet end of said respective preceding air channel section.

* * * * *